United States Patent [19]

Sarikelle

[11] 4,312,606

[45] Jan. 26, 1982

[54] INTERLOCKING PREFABRICATED RETAINING WALL SYSTEM

[76] Inventor: Simsek Sarikelle, 133 Scenic View, Copley, Ohio 44321

[21] Appl. No.: 132,630

[22] Filed: Mar. 21, 1980

[51] Int. Cl.[3] ..... E02D 29/02

[52] U.S. Cl. ..... 405/286; 405/273

[58] Field of Search ..... 405/262, 272, 273, 284, 405/285, 286; 52/582, 588

[56] References Cited

U.S. PATENT DOCUMENTS

| | | | |
|---|---|---|---|
| 2,149,957 | 3/1939 | Dawson | 405/273 |
| 2,879,647 | 3/1959 | Hayden | 405/285 |
| 3,464,211 | 9/1969 | Andresen | 405/262 |
| 3,922,864 | 12/1975 | Hilfiker | 405/262 |

FOREIGN PATENT DOCUMENTS

| | | | |
|---|---|---|---|
| 439362 | 6/1912 | France | 405/262 |
| 966135 | 10/1950 | France | 405/262 |
| 694233 | 9/1965 | Italy | 405/285 |

*Primary Examiner*—David H. Corbin

*Attorney, Agent, or Firm*—Joseph A. Edminister

[57] ABSTRACT

A prefabricated retaining wall system wherein a number of basic components of various shapes and sizes are capable of being assembled in several different arrangements to form a vertical face or sloped face wall, a vertical face or sloped face wall with deadman anchors, a crib or bin type wall, all of which have interlocking parts and post like members which interconnect the components to form an integral wall system which resists sliding and overturning.

10 Claims, 12 Drawing Figures

INTERLOCKING PREFABRICATED RETAINING WALL SYSTEM

BACKGROUND OF THE INVENTION

The present invention relates to retaining wall systems. More specifically it relates to retaining wall systems assembled from several basic components which interconnect and interlock to form an integral structure which resists overturning and sliding. The basic components are capable of being assembled in either a single straight wall structure with stabilizing anchors or in a crib type wall structure of the gravity type.

The need for retaining walls is well known in landscaping and home building, soil stabilization along highways, railroad rights of way, drainage channels, water courses and other similar applications. Soils of many types, if left alone, will move rapidly under adverse hydrostatic conditions. It is often desirable to slope soils steeply because of adjacent structures, or merely for aesthetic purposes. In all cases where soils have been removed, replaced or rearranged it is of importance that the final placement remain fixed for many years even under severe weather conditions. These requirements make it desirable to have a versatile, easily assembled, variable size, low cost retaining wall system.

Other retaining walls assembled from basic components are found in the prior art. Several such systems known to the applicant are disclosed in the following patents:

| | | |
|---|---|---|
| 3,464,211 | September 2, 1969 | Andresen |
| 3,922,864 | December 5, 1975 | Hilfiker |

A thorough investigation of the prior art reveals several systems for retaining soil. Some have large vertical face members while others have shapes suited only for high vertical retaining walls such as are required along railroads and highways. None have been found which can be readily assembled without need for heavy construction equipment. None were found having a small number of basic components capable of being assembled in a crib or bin type or in a standard vertical type retaining wall with or without deadman anchors.

SUMMARY OF THE INVENTION

It is, therefore, an object of the present invention to provide a retaining wall system wherein a few basic parts can be readily assembled on the site to produce a wall of the vertical face or sloped face stack type.

It is a further object of the present invention to provide a retaining wall system of the crib or bin type which resists overturning and sliding.

It is also an object of the present invention to provide a retaining wall system having several basic parts which can be assembled by a small unskilled crew.

It is another object of the present invention to provide a retaining wall wherein the parts are interlocked to form a closed face integral structure with deadman anchor parts or stabilizers which work into the pattern or not as required by the batter ratio and the density and permeability of the soil type.

It is a further object of this invention to provide a retaining wall system having several basic parts wherein the same parts can be utilized for landscaping walls of the type necessary around homes or buildings or assembled to form a high steep slope vertical retaining wall of the type required along highways and railroads.

It is another object of the present invention to provide a set of basic components which can be assembled in various combinations in conjunction with drainage structures such as culverts, bridges, dams, and open channels.

It is a further object of the present invention to provide a retaining wall system which combines all of the above objects, is easily manufactured, readily stored and which is low in cost.

These and other objects of the present invention, together with the advantages thereof over the existing prior art which will become apparent from the specification, are accomplished by the improvements hereinafter described and claimed.

BRIEF DESCRIPTION OF THE DRAWINGS

In the drawings which are illustrative of the preferred embodiment of the invention.

DESCRIPTION OF THE PREFERRED EMBODIMENT

Figure 1:
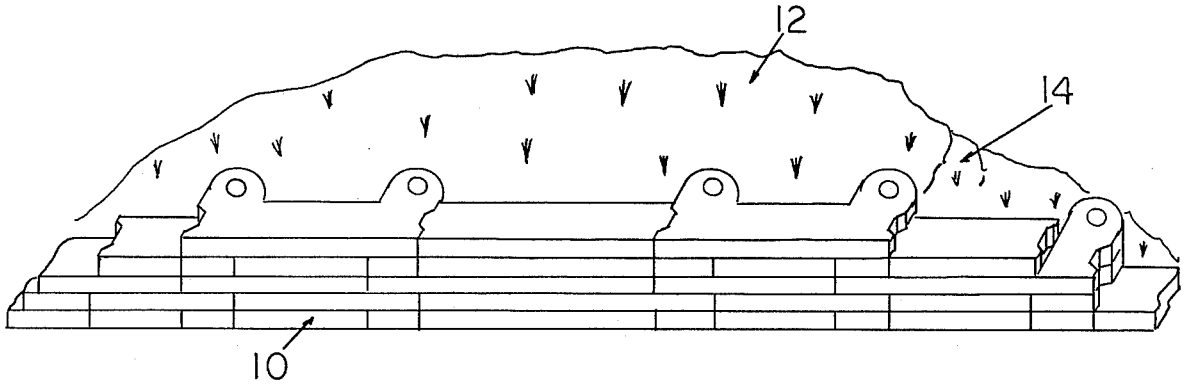
FIG. 1 is an isometric view of the retaining wall system.
Figure 2:
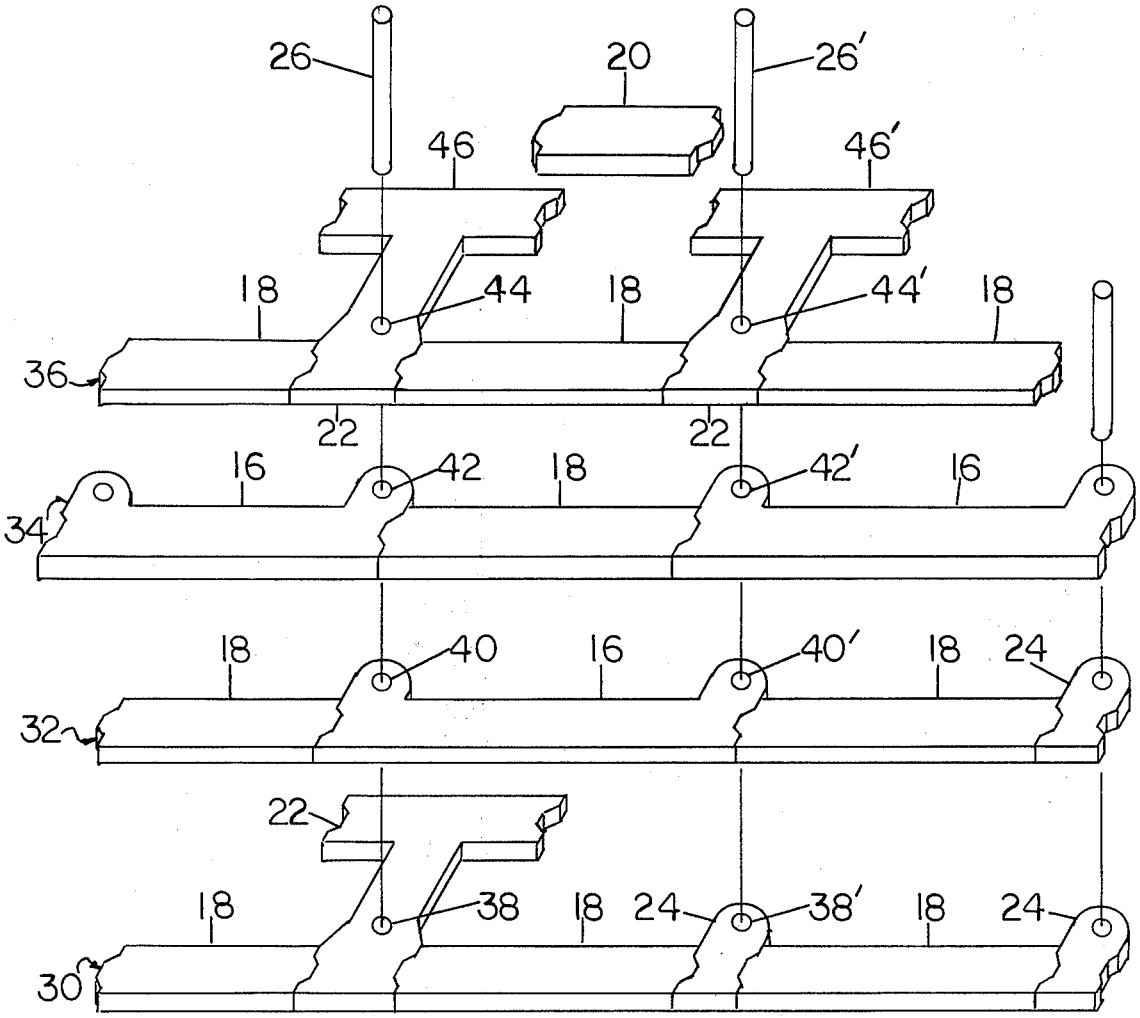
FIG. 2 is an exploded view of the retaining wall system.

Referring now to the drawings, in which identical or similar parts are designated by the same numerals throughout, and referring first to FIG. 1, there is shown the retaining wall designated generally by the numeral 10 holding back the soil designated generally by the numeral 12. The soil at numeral 14 requires a lower vertical face and the courses are reduced accordingly as shown. In FIG. 2 the retaining wall system is shown in exploded view wherein the bottom course 30 contains three size 1 filler components 18, two key components 24 and one standard T component 22. The second tier 32 of the retaining wall contains one tie-bar component 16 in the center and two size 1 filler components 18, one on either side of the tie-bar component, and one key component 24. The third tier 34 contains one size 1 filler component 18 and two tie-bar components 16, one on either side of the filler component. The fourth tier 36 contains three size 1 filler components 18 and two standard T components 22. A size 2 filler component 20 is illustrated in exploded view above the void formed by the back deadman arms 46 and 46'. When the size 2 filler component is in place a crib or bin type structure is formed. The holes 38, 40, 42 and 44 in the components of the bottom, second, third and fourth tiers are positioned directly on top of one another so that post member 26 can be placed through all tiers. Post member 26' on the right can be similarly inserted through holes 38', 40', 42', 44' in tiers 30, 32, 34 and 36. The standard T component 22 in tier 30 may be omitted and its place in the structure taken by a key component 24 if the soil conditions at that level do not require the anchor or deadman effect which the standard T component provides. In soils which have a tendency to slide with a resulting effect of overturning of the retaining wall standard T components 22 can be inserted in each tier from the bottom course 30 to the top course 36 thereby providing a deadman or anchor effect which is continuous. With lower retaining walls or high walls having well compacted impervious soil the standard T components 22 may be omitted entirely. In either case the post members 26 and 26' hold the various components in place resulting in an interlocked closed face wall wherein each component aids the others in resisting sliding and overturning. The retaining wall so formed is an integral structure.

The various components above described in their functional relationships in FIG. 2 are shown individually in FIGS. 4, 5, 6, 7, 8, and 9.

Figure 3:
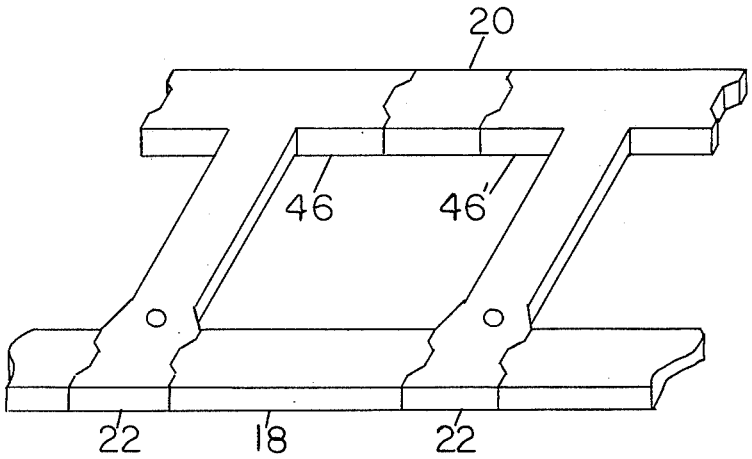
FIG. 3 is a view of the retaining wall parts assembled in a crib or bin type arrangement.
Figure 4:
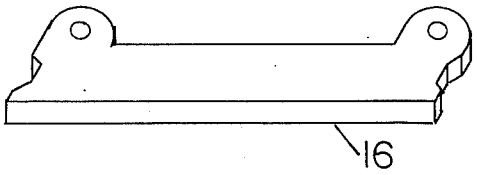
FIG. 4 is a view of the tie-bar component of the retaining wall system.
Figure 9:
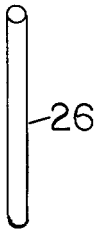
FIG. 9 is a view of the post component.
Figure 7:
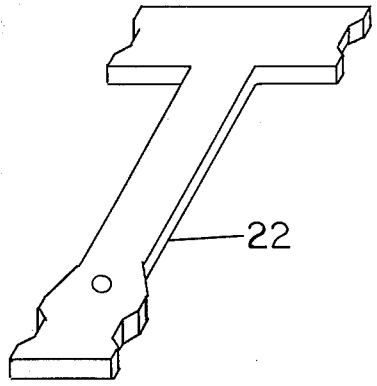
FIG. 7 is a view of the standard T component.
Figure 5:
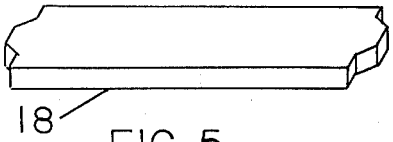
FIG. 5 is a view of the filler component size 1.
Figure 6:
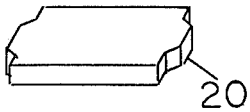
FIG. 6 is a view of the filler component size 2.
Figure 8:
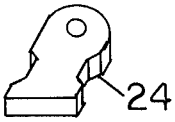
FIG. 8 is a view of the key component.

FIG. 3 is a detailed illustration of the crib or bin type retaining wall assembled from two standard T components 22 which are separated by a size 1 filler component 18 at the front face and a size 2 filler component 20 at the back portion of the wall where it fits tightly between the back deadman arms 46 and 46' of the standard T components 22. In construction of a complete crib type retaining wall this arrangement is continued on the left and right of the single bin shown in the one tier. The tier which will be placed directly above is not shown but contains the same components in the same lateral positions. Post members 26, not shown in FIG. 3, hold the components in place. The compacted fill contained within one rectangular enclosure of the bin or crib thus formed is completely isolated from the fill within the others. With a reasonable bearing resistance of the base soil the completed crib type retaining wall resists sliding, overturning and movement of any kind.

Figure 11:
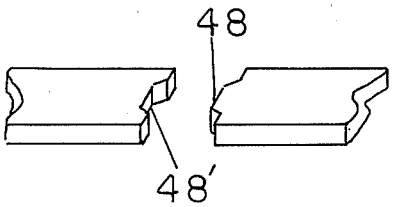
FIG. 11 is a partial view of male and female ends of the simple type notch.
Figure 12:
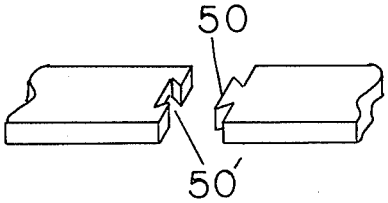
FIG. 12 is a partial view of male and female ends of the locking type notch.

The components making up the structure are illustrated with a simple keyed notch 48 and 48' in FIG. 11 in a first mode. An alternate method of interlocking the components is illustrated in FIG. 12 wherein the keyed notch 50 and 50' contains a reverse angle to prevent movement of the two components opposite directions.

Figure 10:
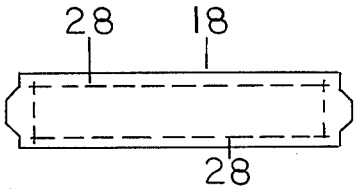
FIG. 10 is a view of a typical component showing the placement of steel reinforcing bars within the concrete.

In FIG. 10 reinforcing bars 28 are illustrated in place within a filler component 18. Depending upon local conditions all other components may contain reinforcing bars similarly placed.

The basic components described and illustrated hereinabove may be fabricated from a variety of materials such as wood, aluminum, steel or steel reinforced concrete, all within the scope of the invention hereinafter claimed.

The retaining wall system illustrated and described in detail in this specification, in accordance with the Patent Statutes, is the preferred embodiment. It is to be understood that the invention is not limited thereto, since it will be apparent to those skilled in the art that a number of modifications, alternatives and other variations are possible. Accordingly, the invention should be considered to include all variations and alterations falling within the scope of the appended claims.

What I claim is:

1. A prefabricated retaining wall system for constraining soils of various types comprising:

(a) a plurality of tie bar components of slab like configuration having a rectangular cross section, upper and lower planar surfaces for horizontal engagement with lower and upper surfaces of tie bar components situated below and above, a front planar surface to produce, in conjunction with other front surfaces, a front face of the retaining wall, a rear planar surface to constrain the soil therebehind, longitudinal ends having notches centrally positioned therein, semicircular projections extending rearwardly at each end tangential to said ends containing apertures therethrough, (b) a plurality of filler components of the same cross section as said tie bar components, with longitudinal ends having projections for engaging notches in said tie bar components, (c) a first horizontal tier having in alternating placement upon the earth tie bar components and filler components with notches and projections in fixed engagement, a second tier of similar alternating arrangement of components placed upon said first tier, third and additional tiers to result in the retaining wall front face having a height required by the soil to be constrained, and (d) a plurality of post components disposed through said apertures to secure the tier bar components and filler components to the earth below creating a unitized structure.

2. The retaining wall system as described in claim 1 wherein said tie bar components and said filler components are of cementicious material.

3. The retaining wall system as described in claim 1 wherein said tie bar components and said filler components are of steel reinforced concrete.

4. The retaining wall system as described in claim 1 wherein said notches and projections contain reverse angle surfaces to lock the components in contact preventing separation in the longitudinal direction.

5. The retaining wall system as described in claim 1 further comprising:

(a) a plurality of T shaped components of the same cross section as said tie bar components, having a stem portion with an end plane surface and having notches on both sides proximate to the end plane surface, and a vertical aperture therethrough, (b) a horizontal tier having in alternating placement T components and filler components with said notches and projections in fixed engagement, said tier placed between said tiers of tie bar and filler components to provide a deadman anchor type unitized structure.

6. The retaining wall system as described in claim 5 further comprising:

(a) a plurality of key components having the same size and structure as the stem portion of said T components including the end plane, notches on both sides proximate the end plane surface, and the aperture therethrough, (b) horizontal placement of said key components in said tier in place of T components so that the tier can be arranged with a variable number of T components, with key components located where T components are omitted.

7. A prefabricated retaining wall system for constraining soils of various types comprising:

(a) a plurality of filler components of a slab like configuration having a rectangular cross section, upper and lower planar surfaces for horizontal engagement with lower and upper surfaces of filler components situated below and above, with longitudinal ends having projections centrally positioned therefrom, (b) a plurality of T shaped components of the same cross section as said filler components having a stem portion with an end plane surface and notches on both sides proximate the end plane surface and a vertical aperture therethrough, having a cross arm portion of said T with notches at the extremities of said cross arm, (c) a first horizontal tier having in alternating placement upon the earth, filler components and T components with projections and notches in fixed engagement, forming a straight front wall face with said T cross arms extending rearward, and filler components placed horizontally between the cross arms of subsequent T components to form closed rectangular configurations in the horizontal plane, (d) a second and additional horizontal tiers of components placed upon lower tiers to result in the retaining wall front face having a height required by the soil to be constrained, and (e) a plurality of post components disposed through said apertures to secure the T shaped components to the earth below creating a rigid, crib type, unitized structure.

8. The retaining wall system as described in claim 7 wherein said filler components and said T components are of cementicious material.

9. The retaining wall system as described in claim 7 wherein the components are prefabricated of steel reinforced concrete.

10. The retaining wall system as described in claim 7 wherein the projections and notches are of the reverse angle, locking type to prevent separation of the components in the longitudinal direction.

* * * * *